United States Patent [19]

Pittman, II

[11] Patent Number: 4,648,012

[45] Date of Patent: Mar. 3, 1987

[54] INTERIOR LIGHT FOR U.S. MAILBOX

[76] Inventor: Richard A. Pittman, II, 113 Royal Cove, Naples, Fla. 33963

[21] Appl. No.: 808,493

[22] Filed: Dec. 13, 1985

[51] Int. Cl.[4] ..... F21V 33/00

[52] U.S. Cl. ..... 362/155; 362/191; 232/17

[58] Field of Search ..... 362/154, 155, 133, 157, 362/190, 191; 315/84; D99/29; 232/17

[56] References Cited

U.S. PATENT DOCUMENTS

| | | | |
|---|---|---|---|
| 1,819,398 | 8/1931 | Wegehoff | 362/154 |
| 3,800,134 | 3/1974 | Castaldo | 362/155 |
| 4,154,393 | 5/1979 | Davishian | 232/17 |
| 4,293,894 | 10/1981 | Blank | 362/191 |
| 4,524,905 | 6/1985 | Crist | D99/29 |

*Primary Examiner*—William A. Cuchlinski, Jr.
*Assistant Examiner*—D. M. Cox
*Attorney, Agent, or Firm*—Merrill N. Johnson

[57] ABSTRACT

Apparatus for lighting the interior of a conventional metal mailbox having a rectangular bottom, a curved top and side section, a closed rear end, an open front end, a hinged cover pivoted about the horizontal base and having at its top a latch which when the cover is closed against the open front end of the box couples with a matching latch mounted at the top of the front end of the mailbox, the apparatus comprising an incandescent lamp having two terminals mounted in a socket depending from the top of the mailbox, a dry cell battery contained within an insulated case mounted beneath the bottom of the mailbox, a push button on-off switch having two terminals mounted on the latch at the front end of the mailbox, an insulated line connecting one terminal of the battery to one terminal of the on-off switch, and a second insulated line connecting the other terminal of the on-off switch to one terminal of the incandescent lamp, the other terminal of the battery being connected to the other terminal of the incandescent lamp through the grounded metal mailbox itself.

2 Claims, 3 Drawing Figures

FIG. 1
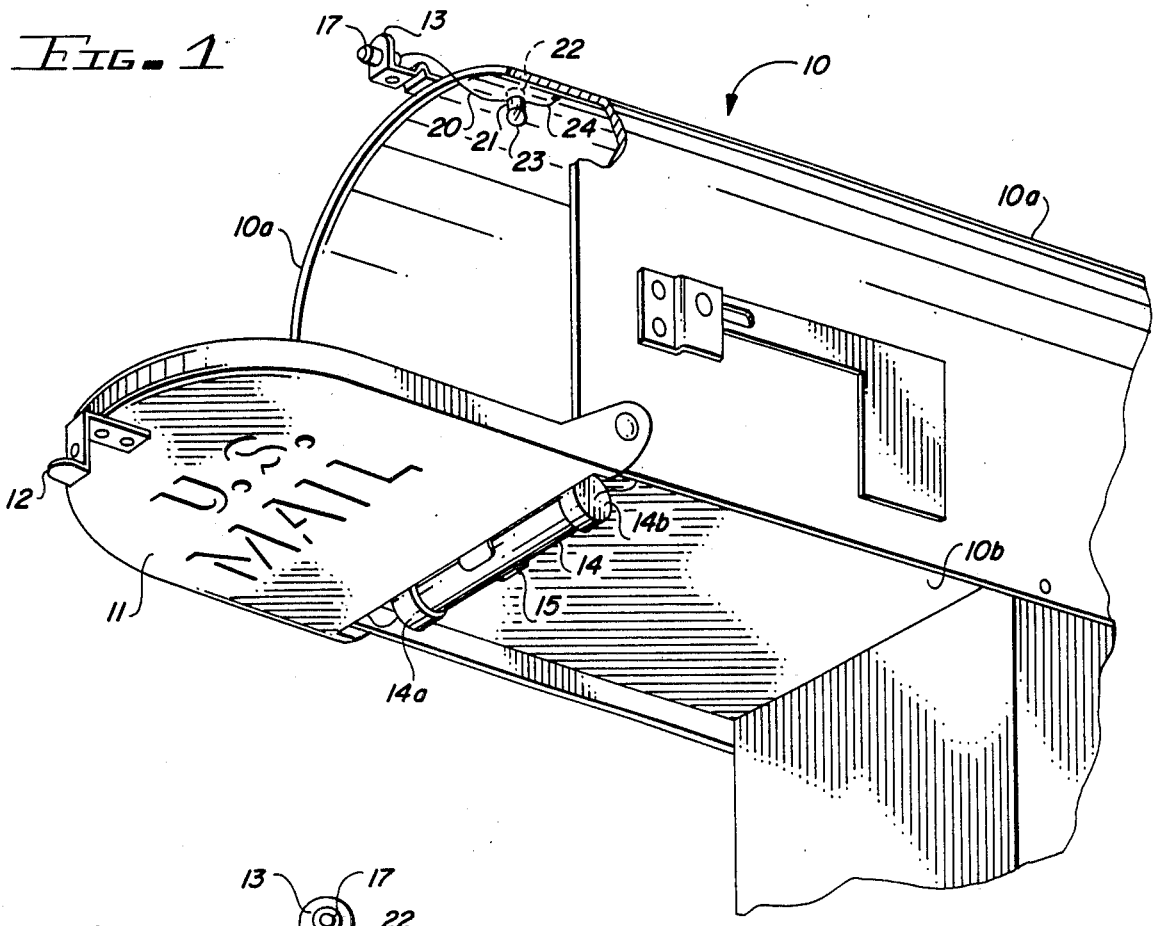
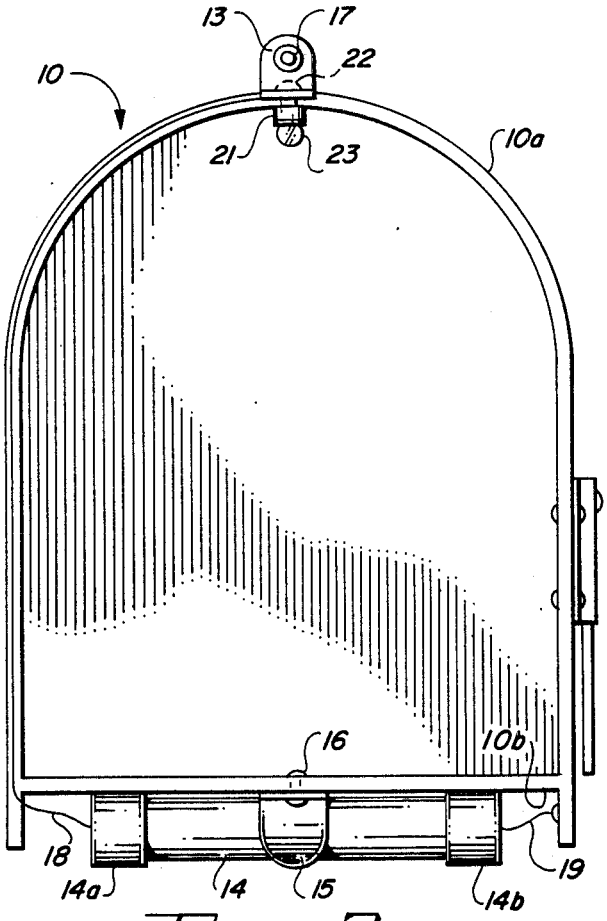
FIG. 2
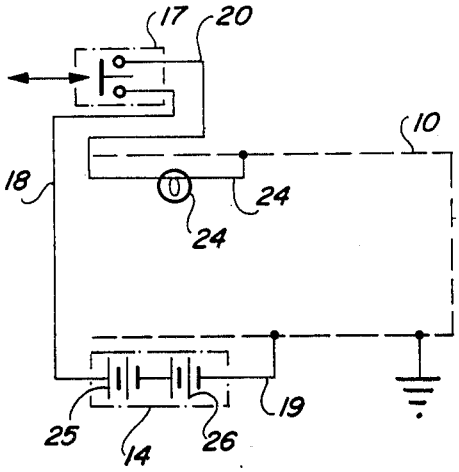
FIG. 3

INTERIOR LIGHT FOR U.S. MAILBOX

BACKGROUND AND SUMMARY OF THE INVENTION

The present invention relates to an improvement for mailboxes, particularly metal mailboxes used by homeowners in rural areas.

Rural mailboxes approved by the U.S. Postal Service conventionally are made of metal with a rectangular horizontal base, a curved top and side section, a closed rear end and an open front end. A hinged door is pivoted near the horizontal base with a latch at its top which, when the door is closed against the open front end of the box, couples with a matching latch on the top of the front end of the box. These boxes are usually located along the road some distance from the owner's house.

The rural mailbox usually receives mail delivered by a mailcarrier during daylight hours. But when the homeowner is employed away from home the box is often checked for mail during the hours of darkness. When the box is opened to determine whether it contains envelopes, post cards or small packages when it is dark or gloomy, it is difficult to quickly and accurately determine whether all the delivered mail is being removed from the box. It is impossible to visually check the contents of the rural mailbox when it is gloomy or during the hours of darkness.

Even when the rural mailbox is illuminated by a nearby street light or the headlights of an automobile, the interior of the box is literally a black hole. Thus the person checking the box for mail is unable to visually determine the contents of the box during late evening or early morning hours.

To permit the owners of mailboxes which are often emptied during the hours of darkness to visually inspect the contents of their mailboxes, I have invented apparatus for lighting the interior of a conventional rural mailbox.

Since most mailboxes are located at a point where conventional 110 volt alternating electric current is not readily available, my apparatus is powered by a pair of 1.5 volt AA dry cell batteries which are protected from the rain and weather by a polyvinyl (PVC) case located beneath the mailbox.

Light to the inside of the box is supplied by an incandescent lamp mounted in a socket attached to the roof of the mailbox. Electricity is fed to the lamp by a pushbutton on-off switch conveniently mounted on the latch which secures the box cover in closed position. Thus when the person desiring to check the box for mail grasps the latch to open the box he will also push the button on the switch to turn on the lamp and illuminate the interior of the mailbox.

Then when the contents of the box have been removed and the person is assured by visual inspection that the box is now empty, the person closes the box cover and again pushes the switch button to turn off the lamp.

BRIEF DESCRIPTION OF THE DRAWINGS

The advantages and features of my invention will be apparent from the following description of a preferred embodiment and the drawings in which:

FIG. 1 is a perspective view partially broken away of a mailbox fitted with my apparatus for illuminating the interior of the box.

FIG. 2 is a front end view of the mailbox shown in FIG. 1.

FIG. 3 is a circuit diagram of the electrical circuit employed in illuminating the mailbox shown in FIGS. 1 and 2.

DETAILED DESCRIPTION OF THE PREFERRED EMBODIMENT

Referring first to FIG. 1, a conventional U.S. Postal Service approved mailbox 10 is shown with its hinged cover 11 in an open position. Box 10 is made of sheet metal and has a hollow rolled front edge 10*a* and a flat rectangular horizontal bottom 10*b*.

The cover 11 is held in its closed position against the open front end of the box 10 by a pair of matching curved latches 12 and 13. Latch 12 is mounted on the top of cover 11 while latch 13 is mounted on the top of the front of box 10. Latch 13 has an upwardly projecting end as shown in FIGS. 1 and 2.

In order to illuminate the interior of box 10 when the box is opened and cover 11 pulled down, an incandescent lamp 23 in a socket 21 is mounted inside the box by means of a metal screw 22. And to permit the person opening and closing the box to conveniently switch on or off the lamp 23, a pushbutton on-off switch 17 is mounted on the top of latch 13 as best shown in FIG. 1.

The electrical circuit for energizing lamp 23 is shown in FIG. 3. A pair of 1.5 volt AA dry cell batteries 25 and 26 are connected in series within a tubular case 14 preferably made of PVC to protect the batteries from rain and weather. The opposite ends of case 14 are closed by PVC caps 14*a* and 14*b*. Case 14 is mounted beneath box bottom 10*b* by means of a U-shaped spring clamp 15 secured to the bottom of the box by a metal screw 16.

An insulation-covered wire 18 has one end connected to the positive terminal of battery 25. Wire 18 is then threaded through the hollow center of the box's rolled edge 10*a* as shown in FIG. 2 to the top of the box and the other end of wire 18 is connected to one terminal of on-off switch 17 mounted on latch 13.

One end of a second insulation-covered wire 20 is connected to the other terminal of switch 17 and the other end of wire 20 is connected to one terminal of lamp 23. The opposite terminal of lamp 23 is connected to the metal mailbox 10 by wire 24 shown in FIGS. 1 and 3. The electrical circuit is completed by insulation-covered wire 19 which connects battery 26 to box 10.

Thus when a person opens box 10 to check its contents for mail, he grasps latch 12 and with the same hand pushes the button on switch 17 to energize lamp 23. The person can now visually inspect the inside of box 10 to be sure he has removed all of its contents regardless of the time of day. On closing box cover 11, the person simultaneously pushes the switch 17 to deenergize the electrical circuit and turn off lamp 23.

While I have shown and described in detail a preferred embodiment of my invention, it should be understood that the invention is not limited to the details shown and described. Rather, the scope and spirit of my invention is limited only by the following claims.

I claim:

1. Apparatus for lighting the interior of a mailbox having a rectangular horizontal bottom, a curved top and side section, a closed rear end, an open front end having a hollow rolled front edge, a hinged cover pivoted about the horizontal base and having at its top a latch when the cover is closed against the open front end of the box couples with a matching latch mounted at the top of the front end of the mailbox, said apparatus including an incandescent lamp having two terminals mounted in a socket attached to the inside of said mailbox, a dry cell battery contained within an insulated case mounted beneath the bottom of said mailbox, a push button on-off switch having two terminals mounted on the latch at the front end of said mailbox, an insulated line connecting one terminal of the battery to one terminal of said on-off switch, an insulated line connecting the other terminal of said on-off switch to one terminal of said incandescent lamp, the other terminal of the battery being connected to the other terminal of said incandescent lamp through the grounded metal mailbox itself, wherein the insulated line connecting the battery to the on-off switch is threaded through the hollow rolled front edge of the mailbox.

2. Apparatus for lighting the interior of a metal mailbox having a rectangular horizontal bottom, a curved top and side section, a closed rear end, an open front end having a hollow rolled front edge, a hinged door pivoted about the horizontal base and having at its top a latch which when the door is closed against the open front end of the box couples with a matching latch mounted at the top of the front end of the mailbox, said apparatus including a incandescent lamp having two terminals mounted in a socket attached to the inside of the top of said mailbox, a pair of 1.5 volt dry cell batteries connected in series within a tubular insulated case mounted beneath the bottom of said mailbox, a push button on-off switch having two terminals mounted on the latch at the front end of said mailbox, an insulated line threaded through the hollow rolled front edge of the box connecting one terminal of the batteries to one terminal of said on-off switch, an insulated line connecting the other terminal of said on-off switch to one terminal of said incandescent lamp, the other terminal of the batteries being connected to the other terminal of said incandescent lamp through the grounded metal mailbox itself.

* * * * *